United States Patent [19]

McIntosh

[11] 4,295,798

[45] Oct. 20, 1981

[54] AUTOMATIC TWO-SPEED PUMP ASSEMBLY

[75] Inventor: Arthur M. McIntosh, Arlington Heights, Ill.

[73] Assignee: Borg-Warner Corporation, Chicago, Ill.

[21] Appl. No.: 80,767

[22] Filed: Oct. 1, 1979

[51] Int. Cl.[3] ..... F04B 35/00

[52] U.S. Cl. ..... 417/212; 74/710.5; 417/364

[58] Field of Search ..... 417/364, 15, 212, 223, 417/316, 319; 418/18; 74/710, 710.5

[56] References Cited

U.S. PATENT DOCUMENTS 2,741,421 4/1956 Wood ..... 415/18 X 2,881,597 4/1959 Jacobs ..... 417/223

3,155,040 11/1964 Shurts et al. ..... 417/223

3,577,965 5/1971 Sundberg ..... 417/212

*Primary Examiner*—Carlton R. Croyle

*Assistant Examiner*—Edward Look

*Attorney, Agent, or Firm*—Julian Schachner

[57] ABSTRACT

An automatic two-speed pump assembly for use with a diesel engine. The assembly includes a transmission capable of driving an associated fuel pump in high- and low-speed ranges, and a fluid control device responsive to pump pressure for shifting the transmission to its low-speed range at a pump pressure corresponding to an engine speed between crank and idle speeds. The fluid control device is responsive to pump pressure for shifting the transmission to its high-speed range at a pump pressure corresponding to an engine speed below crank speed.

11 Claims, 3 Drawing Figures

AUTOMATIC TWO-SPEED PUMP ASSEMBLY

BACKGROUND OF THE INVENTION

This invention relates generally to pump assemblies. More particularly, it relates to an assembly having a pump which is adapted to be driven in two speed ranges, with a shift from one range to the other being effected automatically in response to attainment of a predetermined pump pressure. The assembly automatically is recycled for operation in the original range when pump pressure drops to another predetermined level.

Automotive manufacturers, in particular manufacturers of diesel engines, are faced with the problem of fuel pumps which deliver low capacity at engine cranking speeds. One solution to such a problem would be to drive two fuel pumps at engine cranking speeds, and to provide some way to cut off one of them after engine start-up. Obviously, the necessity of providing two pumps and suitable control apparatus is both costly and inefficient.

There remains a need in the art for a simple, inexpensive two-speed pump assembly which will deliver fluid at a relatively high capacity initially and which will shift automatically to deliver fluid at a relatively low capacity after the initial need has been met.

SUMMARY OF THE INVENTION

This invention is directed to such an automatic two-speed pump assembly. To that end, the assembly includes a two-speed transmission which in one mode initially drives a fluid pump in a first speed range. Pump output is sensed by an appropriate fluid control device, which shifts the transmission to another mode in response to a predetermined pump output condition. Once shifted, the transmission continues to drive the pump in a second speed range. The fluid control device is arranged to maintain the transmission in its second drive mode until engine shut-down, and then to control shifting of the transmission back to the first drive mode.

BRIEF DESCRIPTION OF THE DRAWINGS

The objects and the advantages of this invention will become apparent to those skilled in the art upon careful consideration of the specification herein, including the drawings, wherein.

Figure 1:
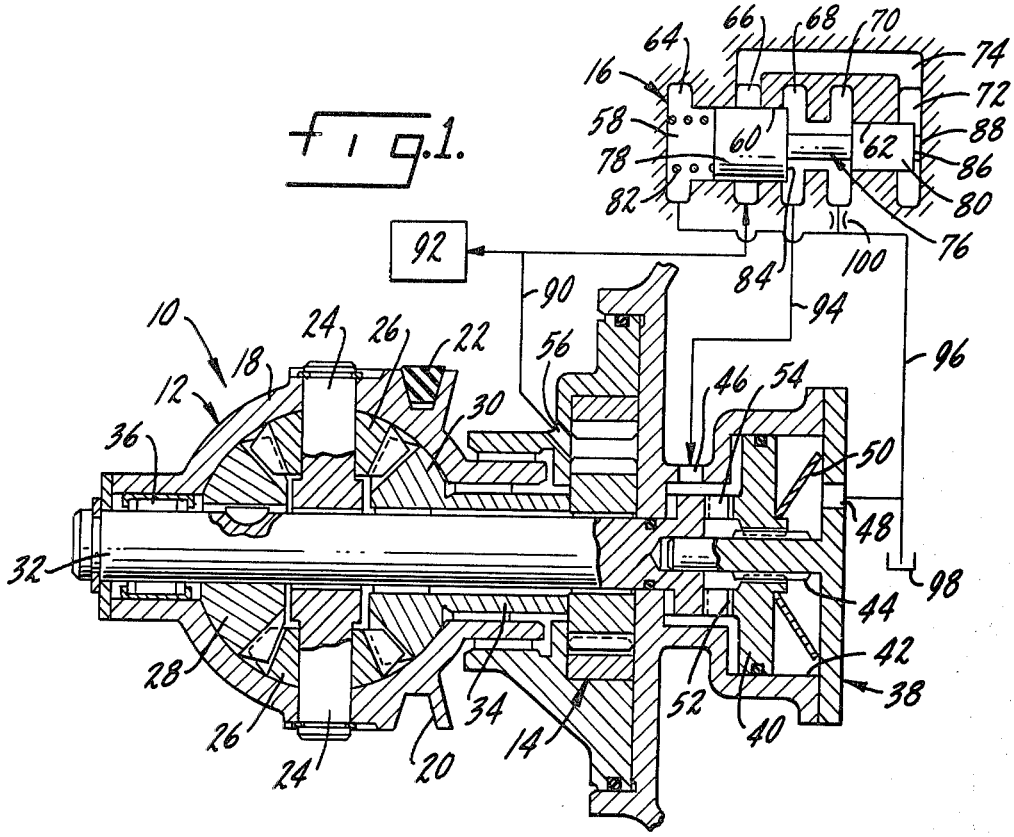
FIG. 1 is a sectional and schematic view showing details of the automatic two-speed pump assembly.

While this invention is susceptible of embodiment in many different forms, there is shown in the drawings and herein will be described in detail a preferred embodiment. It should be understood that the present disclosure is considered to be an exemplification of the principles of the invention, and is not intended to limit the invention to this embodiment.

DESCRIPTION OF A PREFERRED EMBODIMENT

Referring to the drawings in further detail, and with particular reference to FIG. 1, there is shown an automatic two-speed pump assembly 10. Assembly 10 includes a two-speed transmission 12, a fluid pump 14 and fluid control apparatus 16.

In a preferred form of the invention, transmission 12 is of the planetary type. As shown in FIG. 1, a particular planetary transmission is in the form of a differential having as a first rotatable member an input case 18. This case 18 defines a suitable sheave 20 arranged to receive a drive belt 22.

Case 18 supports a plurality of pinion shafts 24, with each shaft 24 rotatably supporting an associated pinion gear 26. In mesh with pinion gears 26 are a first side gear 28 and a second side gear 30. Gear 28 is secured to a second, intermediate rotatable member in the form of a shaft 32 received within case 18. Gear 30 is secured to a third, output rotatable member in the form of an annular shaft 34 concentric with shaft 32. Shafts 32,34 extend outwardly beyond case 18. A suitable one-way clutch-/bearing 36 couples shaft 32 with case 18. Clutch 36 is conventional in nature and need not be described in detail.

Transmission 12 also includes a suitable brake assembly 38. In a preferred form of the invention, brake 38 may be in the form of a jaw clutch or the like capable of grounding shaft 32.

Brake 38 includes a piston 40 which is slidably received in a cylinder 42 so as to divide cylinder 42 into first and second cylinder portions. Piston 40 is splined or otherwise secured as at 44 to the housing for sliding movement relative thereto. Formed in this housing are ports 46 and 48 which respectively communicate with the first and second portions of cylinder 42. A Bellville spring 50 or the like within the second portion of cylinder 42 biases piston 40 inwardly. Piston 40 defines inwardly facing jaw clutch teeth 52. Shaft 32 extends into the first portion of cylinder 42 and defines outwardly facing jaw clutch teeth 54 which complement and are engagable with teeth 52. Thus, in a preferred form of the invention, brake 38 is spring-engaged, thereby grounding shaft 32.

Pump 14 is conventional in nature. In a preferred form of the invention, it is located within the housing and is connected to shaft 34 so as to be driven thereby. Formed in the housing is a convenient pump outlet 56.

Fluid control apparatus 16 includes a stepped valve bore 58 defined by the housing. Bore 58 includes a first, relatively large diameter bore portion 60 and a second, relatively small diameter bore portion 62. Fluid ports 64, 66, 68, 70 and 72 communicate with bore 58. A fluid passage 74 communicates port 66 with port 72.

Slidably received in bore 58 is a valve spool 76. Spool 76 defines a first land 78 of relatively large diameter slidably received in bore portion 60, and a second land 80 of relatively small diameter slidably received in bore portion 62. A suitable spring 82 biases spool 76 toward a first position in which land 78 blocks fluid communication between port 66 and bore 58. In this position, ports 68,70 are in fluid communication with bore 58.

Opposite spring 82, land 78 defines a surface 84. Similarly, land 80 defines a surface 86 from which extends a flange having a smaller surface 88. This surface 88 abuts the housing to limit movement of spool 76 under the biasing influence of spring 82.

A fluid line 90 communicates outlet 56 of pump 14 with a load 92. In an environment where assembly 10 is associated with a diesel engine, pump 14 might be a fuel pump and load 92 a fuel injector for the engine. Line 90 also communicates with port 66, which serves as an inlet port. A fluid line 94 communicates port 68, which serves as an outlet port, with port 46 of cylinder 42. Finally, a fluid line 96 communicates ports 64,70, as well as port 48 of cylinder 42, with a fluid reservoir 98. In a preferred form of the invention, an orifice 100 is provided in line 96 so as to restrict fluid flow from port 70 to reservoir 98.

In operation, it may be assumed that assembly 10 is used in conjunction with an associated diesel engine. With the engine shut off, assembly 10 would be in the position shown in FIG. 1. Brake 38 is spring-engaged, thus grounding shaft 32. Valve 16 is in its first, rightward position.

Figure 3:
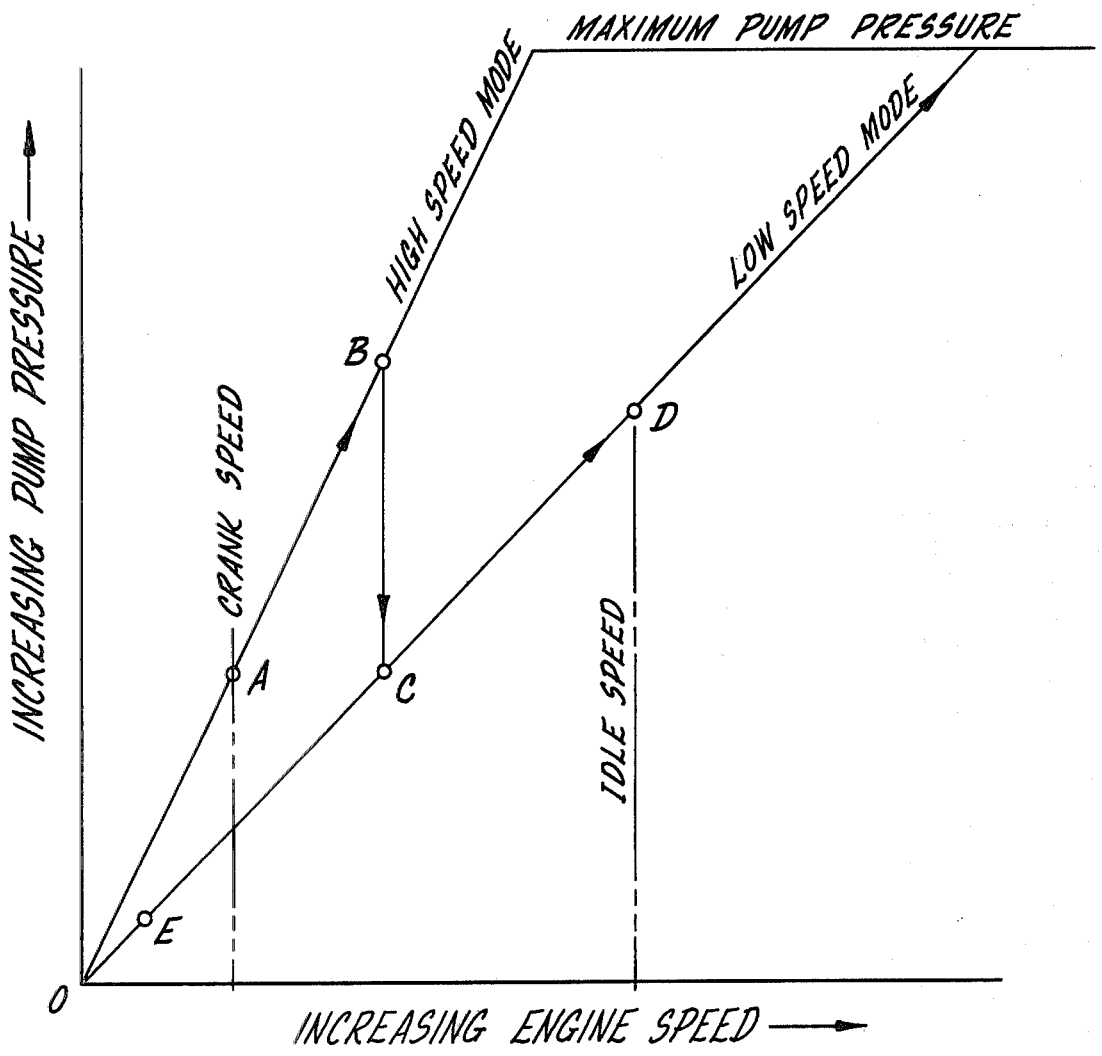
FIG. 3 is a graph illustrating a shift sequence for the assembly.

Initially the engine is rotated at crank speed. Case 18 is rotated by the engine through belt 22 or any other suitable drive apparatus. With shaft 32 grounded, side gear 28 acts as a reaction member, and side gear 30 drives shaft 34 at a speed twice that of case 18. In this mode, pump 14 is driven in a first, relatively high speed range. Pump 14 delivers fuel to injector 92 at some pressure A on the line OB of FIG. 3. This pressure A is sensed at surface 86 of valve spool 76, but is not sufficient to overcome the biasing force of spring 82. Thus, at engine crank speed, valve 16 does not shift.

When the engine starts, increasing engine speed will cause an increasing pump pressure. This pressure will be sensed at surface 86. At some predetermined pressure B, valve 16 will shift. Spool 76 will slide to the left. Fluid communication from port 66 to bore 58 will be established, and at the same time fluid communication from bore 58 to port 70 will be be blocked. Fluid pressure now will act on surfaces 84,86,88, thereby holding spool 76 in its second, leftward position with a force considerably greater than the biasing force of spring 82.

Fluid will flow from line 90 through bore 58 and line 94 into cylinder 42. Piston 40 will move to the right against the biasing force of Bellville spring 50. Teeth 52 will disengage from teeth 54, thereby releasing shaft 32 for rotation. One-way clutch 36 will engage, locking shaft 32 to case 18. In this mode, transmission 12 is locked up, and shaft 34 will rotate in unison with case 18. The rotational speed of pump 14 will be reduced, and pump pressure correspondingly will be reduced from point B to point C. Thereafter, increasing engine speed results in a correspondingly increasing pump pressure along the line OD, with the point D representing the pump pressure at engine idle speed. Engine speeds above idle will result in pump pressures beyond point D up to some maximum pump pressure determined by, for example, the setting of a suitable relief valve or the like.

When the engine is shut off, pump pressure drops along the line OD. When the pressure drops to some predetermined point E, the biasing force of spring 82 will exceed the force of fluid acting upon surfaces 84,86,88, at which time spool 76 will shift to the right. This will place bore 58 in fluid communication once again with port 70. Fluid will drain from cylinder 42 through line 94, bore 58 and line 96 to reservoir 98, and at some point brake 38 will engage under the biasing force of Bellville spring 50. In a preferred form of the invention, orifice 100 delays the relief of fluid from cylinder 42 long enough such that the engine comes to a complete stop before brake 38 engages. This will prevent any undesirable ratcheting between teeth 52,54.

Figure 2:
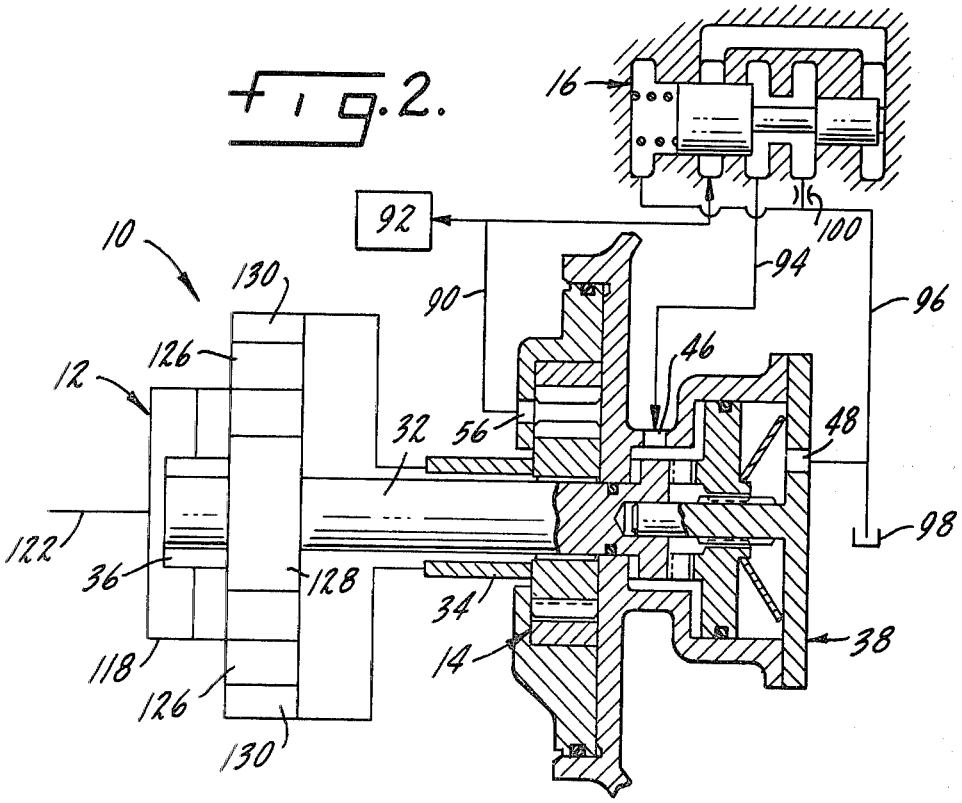
FIG. 2 is a sectional and schematic view showing details of a modified assembly.

In FIG. 1, transmission 12 is in the form of a differential. With this arrangement, the high-speed drive mode establishes drive for pump 14 at twice the input speed to transmission 12. If it is desired to provide a pump speed ratio other than 2:1, transmission 12 might be in the form of a planetary gear set as shown in FIG. 2. Carrier 118 corresponds to case 18. Gears 126,128,130 respectively correspond to gears 26,28,30. Input 122 corresponds to belt 22. Operation of the planetary gear set is the same as that of the differential, but with a pump speed ratio other than 2:1 in the high-speed mode. In the low-speed mode, the pump speed ratio remains 1:1.

As disclosed herein, the assembly may be designed as a plug-in module for use as the fuel pump of an associated diesel engine. Inexpensive gears may be used, as they are relied upon only during the short speed-increasing start cycle. Durability is increased while noise is decreased. The result is a compact arrangement of low cost elements which give a two-speed pump with automatic control.

By providing a manual valve in addition to or in place of valve 16, the option of manual control or boost may be obtained.

It is apparent that although the invention as disclosed herein provides a novel arrangement for using an automatic two-speed pump assembly in conjunction with a diesel engine, it is readily available for use in other environments where such two-speed pump operation may be desired.

It should be understood that while a preferred embodiment of the invention has been shown and described, this should be considered illustrative and may be modified by those skilled in the art. It is intended that the claims herein cover all such modifications as may fall within the spirit and scope of the invention.

What is claimed is:

1. An automatic two-speed pump assembly comprising a transmission shiftable to first and second operating modes, said transmission including fluid operated means movable between first and second positions for respectively shifting said transmission to said first and second modes, and means biasing said fluid operated means toward its first position; a pump engaged with said transmission so as to be driven thereby; and means operative in response to pump pressure for controlling the shift of said transmission from said first to said second mode at a first pump pressure and from said second to said first mode at a second pump pressure, said controlling means including valve means movable between first and second positions, said valve means in its first position communicating said fluid operated means with a fluid reservoir such that said fluid operated means is moved to its first position by said biasing means, and said valve means in its second position communicating said pump with said fluid operated means such that said fluid operated means is moved to its second position in opposition to said biasing means, said controlling means also including resilient means biasing said valve means toward its first position, said valve means defining a relatively small surface area subject to pump pressure when in its first position and a relatively large surface area subject to pump pressure when in its second position such that said valve means is movable from its first to its second position by a relatively high jump pressure and from its second to its first position by said resilient means in opposition to a relatively low pump pressure.

2. The invention of claim 1, said controlling means including means restricting said fluid communication of said fluid operated means with the reservoir when said valve means is in its first position such that movement of said fluid operated means to its first position is delayed upon movement of said valve means to its first position.

3. An automatic two-speed pump assembly comprising a two-speed transmission; a pump; and fluid control apparatus; said transmission including planetary gear means having input, intermediate and output members, said planetary gear means being constructed and arranged to provide drive from said input member to said output member in a first relatively high-speed mode when said intermediate member is grounded and a second relatively low-speed mode when said intermediate member is locked to said input member, clutch means coupling said intermediate member with said input member for locking them in response to rotation of said intermediate member, and brake means for said intermediate member, said brake means being biased to a first position grounding said intermediate member and being movable by fluid pressure to a second position releasing said intermediate member for rotation; said pump being connected to said output member so as to be driven thereby; and said fluid control apparatus communicating with said pump and said brake means for directing fluid pressure to said brake means in response to attainment of a first predetermined pump pressure and for relieving said fluid pressure in response to attainment of a second predetermined pump pressure.

4. The invention of claim 3, said transmission being a differential wherein said input member is the differential case and said intermediate and output members are first and second shafts respectively connected to the first and second side gears of said differential.

5. The invention of claim 3, said transmission being a planetary gear set wherein said input member is a planet carrier and said intermediate and output members are first and second shafts respectively connected to the sun and ring gears of said planetary gear set.

6. Apparatus comprising an engine; a transmission driven by said engine, said transmission having high- and low-speed operating modes and including means movable to first and second positions respectively for shifting said transmission to its high- and low-speed modes, and means biasing said shifting means for movement to its first position so as to shift said transmission to its high-speed mode; a pump driven by said transmission, said pump communicating with said engine for supplying fuel thereto; and control means responsive to a pump pressure developed at an engine speed above crank speed for moving said shifting means to its second position in opposition to said biasing means so as to shift said transmission to its low-speed mode.

7. The invention of claim 6, said control means being responsive to a pump pressure developed at an engine speed between crank and idle speeds for moving said shifting means to its second position.

8. The invention of claim 6 or 7, said control means being responsive to a pump pressure developed at an engine speed below crank speed for relieving the opposition to said biasing means such that said shifting means is moved to its first position.

9. The invention of claim 8, said control means being constructed and arranged to delay said relief of opposition to said biasing means so as to delay the shift of said transmission to its high-speed mode until engine shutoff.

10. An automatic two-speed pump assembly comprising a transmission shiftable to first and second discrete operating modes, said transmission including fluid operated means movable between first and second positions for respectively shifting said transmission to said first and second modes, and means biasing said fluid operated means toward its first position; a pump engaged with said transmission so as to be driven thereby; and means operative in response to pump pressure for controlling the shift of said transmission from said first to said second mode at a first pump pressure and from said second to said first mode at a second pump pressure, said controlling means including valve means movable between first and second positions, said valve means in its first position blocking communication of said pump with said fluid operated means and communicating said fluid operated means with a fluid reservoir such that said fluid operated means is moved to its first position by said biasing means, to said valve means in its second position blocking communication of said fluid operated means with the reservoir and communicating said pump with said fluid operated means such that said fluid operated means is moved to its second position in opposition to said biasing means.

11. The invention of claim 10, said controlling means including means restricting said fluid communication of said fluid operated means with the reservoir when said valve means is in its first position such that movement of said fluid operated means to its first position is delayed upon movement of said valve means to its first position.

* * * * *